US007470850B2

(12) United States Patent
Poultney et al.

(10) Patent No.: US 7,470,850 B2
(45) Date of Patent: Dec. 30, 2008

(54) INTERACTIVE VOICE RESPONSE METHOD AND APPARATUS

(75) Inventors: Timothy David Poultney, Southampton (GB); David Seager Renshaw, Winchester (GB); Matthew Whitbourne, Horndean (GB)

(73) Assignee: International Business Machines Corporation, Armonk, NY (US)

( * ) Notice: Subject to any disclaimer, the term of this patent is extended or adjusted under 35 U.S.C. 154(b) by 926 days.

(21) Appl. No.: 11/003,240

(22) Filed: Dec. 3, 2004

(65) Prior Publication Data

US 2005/0120867 A1 Jun. 9, 2005

(30) Foreign Application Priority Data

Dec. 3, 2003 (GB) ..... 0327991.6

(51) Int. Cl.

| | |
|---|---|
| ***G10H 1/00*** | (2006.01) |
| ***G10H 1/18*** | (2006.01) |
| ***G10H 7/00*** | (2006.01) |

(52) U.S. Cl. ..... 84/615; 84/645; 379/88.18; 379/917

(58) Field of Classification Search ..... 84/609, 84/615, 645; 379/88.18, 917
See application file for complete search history.

(56) References Cited

U.S. PATENT DOCUMENTS

| | | | | |
|---|---|---|---|---|
| 5,844,158 | A * | 12/1998 | Butler et al. | 84/650 |
| 6,446,040 | B1 | 9/2002 | Socher et al. | |
| 2005/0129196 | A1 * | 6/2005 | Creamer et al. | 379/88.18 |

* cited by examiner

*Primary Examiner*—Jeffrey Donels
(74) *Attorney, Agent, or Firm*—Akerman Senterfitt

(57) ABSTRACT

An interactive voice response method and system comprising a VoiceXML browser for processing an interaction with a user. A music score (for example a MIDI file) describing background music for playing during the interaction, and a music synthesizer for generating background music from the music score and from acoustic parameters are included. Acoustic parameters are generated whereby the music synthesizer may be controlled independently of the music score to change the audio environment during an interaction.

2 Claims, 5 Drawing Sheets

```
501  <vxml>

502  <music src="shareshop-bkgnd.mid">

503  <block>

504  <prompt><music tag="happy">Thank you for calling the share
     shop</mood></prompt>

505  <prompt>Your Acme shares are <music tag="calm">down
     $5</mood></prompt>

506  <prompt>The market is closing in 1 minute <music tag="urgent">
     To purchase further shares today you will need to act
     quickly</mood></prompt>

507  </block>

508  </music>

509  </vxml>
```

FIG. 5

INTERACTIVE VOICE RESPONSE METHOD AND APPARATUS

CROSS-REFERENCE TO RELATED APPLICATIONS

This application claims the benefit of British Patent Application No. 0327991.6 filed Dec. 3, 2003.

BACKGROUND

1. Technical Field

This invention relates to a method and apparatus for an interactive voice response system. In particular the invention relates to a method and apparatus for controlling background effects in an interactive voice response dialogue.

2. Description of the Related Art

The telephone is a nearly universal means of communication. All businesses and most homes have one. In the world of e-business, the telephone is an important means of communication, as it gives customers more choice in the way they do business with a company. In particular, a Web site with voice processing can be useful in order to enable a company to expand Web-based business transactions to the telephone. Most people are becoming familiar with using the telephone to conduct various kinds of business including ordering goods from catalogs, checking airline schedules, querying prices, reviewing account balances, recording and retrieving messages, and getting assistance from company help desks. In each of these examples, a telephone call involves an agent performing the following: talking to the caller, getting information, entering that information into a business application, and reading information from that application back to the caller. Voice response technology, for example as provided by WebSphere Voice Response, allows one to automate this process.

WebSphere Voice Response can handle inbound calls, make outbound calls, can transfer calls, and can interact with callers using spoken prompts. Callers can interact with WebSphere Voice Response by using speech (with speech recognition) or the telephone keypad. WebSphere Voice Response responds by speaking information to callers, such information having been pre-recorded or synthesized from text (with text-to-speech). WebSphere Voice Response can access, store, and manipulate information on local or host databases, and on multiple databases on multiple computers. WebSphere Voice Response applications can store and play back messages, support multiple voice applications on a single host, share voice data, applications, and messages across multiple hosts, and allow a choice of application programming environments including VoiceXML, Java and state tables. VoiceXML is an industry-standard voice programming language, designed for developing DTMF and speech-enabled applications, which are then located on a central web server, in the same way as other web applications. WebSphere Voice Response Java can be used for developing voice applications on multiple WebSphere Voice Response platforms, or for integrating voice applications with multi-tier business applications. State tables can be used for optimizing performance or for using all the WebSphere Voice Response functions, including ADSI, TDD, Fax and Custom Servers.

An interactive voice response system (IVR) that plays background effects is described in U.S. Pat. No. 6,446,040 to Socher, et al. (Socher). The Socher patent discloses a method and apparatus of synthesizing speech from a piece of input text. The method includes steps of retrieving the input text entered into a computing system and transforming the input text of at least one word of the input text to generate a formatted text for speech synthesis. The transforming step includes adding an audio rendering effect to the input text based on at least one word, the audio effect comprising background music, special effects and context sensitive sounds. However this IVR plays pre-recorded background music, pre-recorded special effects and pre-recorded context sensitive sounds and does not provide for runtime manipulation of the background music.

SUMMARY OF THE INVENTION

According to a first aspect of the present invention there is provided an interactive voice response system comprising a voice application interpreter for processing an interaction with a user, a music score describing background music for playing during the interaction, a music synthesizer for generating music from the music score in accordance with acoustic parameters, and means for controlling the music synthesizer whereby the acoustic parameters may be controlled in response to the interaction with the user and independently of the music score.

A presently preferred embodiment of the invention is an interactive voice response system that plays background music over a voice channel and where acoustic parameters of the music synthesizer are controlled to effect a change in the mood of the background music independent of the music score. The control of the synthesizer can be performed by a voice application in the case of user IVR interaction or by an agent in the case of a call center interaction. Each of these interactions is described in a separate embodiment in the description.

According to a first embodiment for a user IVR interaction, the means for controlling can comprise a voice application and a score manipulator. The score manipulator can send music commands to the synthesizer under the control of the voice application at the same time as sending the music score for the background music.

By changing the acoustic parameters of the music independently of the music score it is possible to change the audio environment during an interaction.

A music tag parser can read VoiceXML music tags embedded in a voice application. Using this technique, lines of application code can be 'tagged' with predefined emotion or mood. During the interaction, music can be played in the background. For example, a known VoiceXML tag is associated with a command for requesting a text-to-speech engine to output voice data and an extended VoiceXML music tag is associated with adjustment of the background music to give the voice data more emphasis. One simple VoiceXML music tag could simply request that the background music volume be lowered while a prompt is played out.

In another example, the pitch of the music piece may drop an octave and move to a minor key to symbolize an important prompt announcement. For example, a musical score may be stored in a MIDI format. By inserting music commands during the play out of the musical score it is possible to change the mood without affecting the music itself. For example, speeding the music up would create a sense of urgency, changing to a minor key could imply that something serious or unfortunate had happened or a triumphant major key could signify an operation's success. An application prepared for a text-to-speech generator can be tagged with an appropriate music tag, such that when the browser interprets this music tag text, the background music would be altered in order to create the desired acoustic environment.

According to another embodiment, the IVR can further comprise a music manipulation application whereby the interaction is between the user and an agent, and the music manipulation application can control the acoustic parameters of the synthesizer as directed by the agent.

DESCRIPTION OF DRAWINGS

In order to promote a fuller understanding of this and other aspects of the present invention, an embodiment of the invention will now be described, by way of example only, with reference to the accompanying drawings in which:

FIG. 5 shows a diagram of an example voice application containing music tags.

DESCRIPTION OF THE EMBODIMENTS

Figure 1:
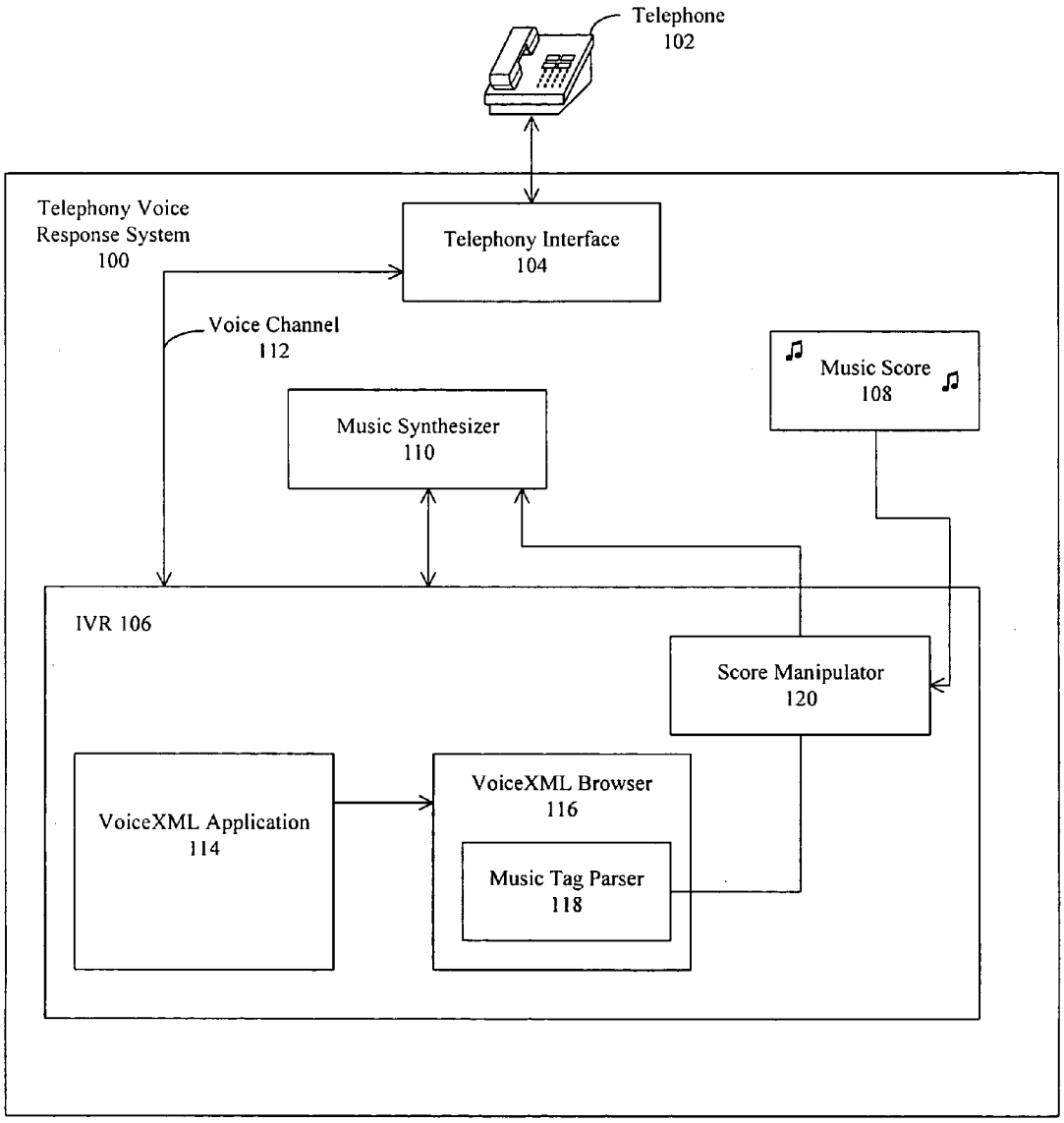
FIG. 1 shows a schematic diagram of a telephony system according to a first embodiment.

Referring to FIG. 1, there is shown a telephony voice response system 100 connected to a telephone 102 according to a first, presently preferred embodiment of the invention. The telephony voice response system 100 can comprise: telephony interface 104, interactive voice response system (IVR) 106, music score 108, and music synthesizer 110. The telephone 102 connects to the telephony interface 104 and IVR 106 over a telephony network (not shown) and allows a user of the system to interact by listening to and speaking with the IVR 106 over a voice channel.

The telephony interface 104 enables the IVR 106 to access any telephone connected to the telephony network using a voice channel 112.

The IVR 106 can comprise a VoiceXML application 114, a VoiceXML browser 116, a music tag parser 118, and a music score manipulator 120. The VoiceXML browser 116 parses and interprets tags in the VoiceXML application 114. The VoiceXML application 114 and associated VoiceXML tags form a framework within which the call is handled and the interaction takes place. The music tag parser 118 identifies the extended VoiceXML tags.

The music score 108 can be a MIDI music file representing the background music to be played over the voice channel of the telephone voice response system 100. In this embodiment the music score 108 comprises MIDI music commands for playing a piece of music. The music commands represent two categories: 1) the music commands for notes that are to be played; and, 2) the music commands for acoustic controls that determine how the notes sound when played through the synthesizer. Both types of command are received by the synthesizer 110 for execution. For instance, notes are represented by pitch and duration whereas the acoustic characteristics can represent volume, tempo, harmonics, pitch variation, pitch level, pitch contour, envelope, and amplitude variation. Two other distinctions are identified as follows: music commands originating in the music score and music commands originating from the VoiceXML application. Music commands originating from the VoiceXML application are initiated by the score manipulator 120 from VoiceXML music tags in the VoiceXML application 114. In the first embodiment the music tags in the VoiceXML application 114 are more closely associated with acoustic commands but it is also possible for music commands for notes to be associated with VoiceXML music tags and included in the VoiceXML application 114.

The music synthesizer 110 can be a digital music processor supporting the MIDI standard including the MIDI music commands in the music score. The music commands are received by the synthesizer 110 in the order they are sent from the score manipulator. The music commands are processed by the synthesizer 110 and then output in a constant audio stream on the voice channel. The music commands are sent in batches and processed as they are received. The smaller the batch the quicker changes can be made in response to a music tag in the VoiceXML application. The synthesizer can have many voices which are output to any one of the voice channels. When music commands are sent to the synthesizer it is important to identify the telephony voice channel in respect of the particular voice application. The music synthesizer matches the synthesizer voice with the telephony voice channel.

The VoiceXML application 114 can comprise a sequence of VoiceXML tags for controlling the interaction, each tag effecting one part of the interaction. VoiceXML is a voice extension of XML (extensible mark-up language) for interactive voice response applications. Known VoiceXML tags are associated with voice commands to make and disconnect calls, to play voice prompts either by text-to-speech or by speech synthesis, to accept input either in speech or keypad tones, and to initiate the play out of background music. VoiceXML may be further extended with new XML tags and this embodiment introduces VoiceXML music tags to control the background music. A VoiceXML music tag (referred to hereafter as simply 'music tag') determines how the background music should be altered to affect the mood of an interaction. A music tag can indirectly control the music synthesizer 110 because it is associated with a music command that can directly control the synthesizer.

The VoiceXML browser 116 interprets the VoiceXML application 114 to control the dialog with the user. The VoiceXML browser 116 is reliant on the IVR 106 and telephony interface 104 to establish telephone calls. The VoiceXML browser 116 passes unidentified VoiceXML tags to the music tag parser 118 which checks for the music tags. If the VoiceXML tags are not recognized as music tags by the music tag parser 118 then control is returned to the VoiceXML browser.

The music tag parser 118 forwards recognized VoiceXML tags, the music tags, to the score manipulator 120 for conversion to a music command. A music tag is associated with music commands that uses specified attributes to adjust the music in line with a certain predefined mood. All mood changes are relative to the current background music playing from a MIDI music file. Moods can be defined using musical characteristics to create a desired effect, for example by changing tempo, adding harmonics, etc. The 'weight' of the change required gives one possible example of how much a piece of music should be altered relative to a change in mood. These required changes can then be sent to the score manipulator 120 to alter the background music the caller is hearing.

When the VoiceXML browser 116 initiates play out of the background music for a particular instance of a VoiceXML application 114, a telephony voice channel 112 identifier is included along with the request. All subsequent VoiceXML music tags sent from this instance of the VoiceXML application 114 include this voice channel identifier so that music commands are performed on the correct background music score. The music synthesizer 110 needs to know the music command and a voice channel in order to execute the music command correctly.

The score manipulator 120 forms packets of music commands from the music score and sends them in regular bursts to the music synthesizer 110. Packets ensure a pool of note commands for smooth transmission of the background music while allowing a music command sent from the VoiceXML application 114 between packets to have a near instantaneous effect. The score manipulator 120 receives a music tag and applies algorithms to change it into its associated music command. The packets of music commands that are formed in the score manipulator 120 includes a telephony voice channel 112 identifier.

Music tags can represent two types of music command: 1) single music commands with just one music tag to represent one music command; and, 2) compound acoustic commands with one music tag to represent several simultaneous music commands.

VoiceXML music tags associated with single music commands are summarized in the following table.

| VoiceXML Music tag = weight | Music command = weight |
|---|---|
| Volume = 1 to 10 | Volume = 1 to 10 |
| Tempo = fast/normal/slow | Tempo = fast/normal/slow |
| Harmonics = few/normal/many | Harmonics = few/normal/many |
| Pitch variation = large/normal/small | Pitch variation = large/normal/small |
| Pitch level = low/normal/high | Pitch level = low/normal/high |
| Pitch contour = down/normal/up | Pitch contour = down/normal/up |
| Envelope = round/sharp | Envelope = round/sharp |
| Amplitude variation = small/normal/large | Amplitude variation = small/normal/large |

The music tags have a similar look to the music commands in this preferred embodiment and other embodiments will depend on the type of music synthesizer actually used.

Music has been known to reduce stress levels when it becomes more prominent in the listener's environment. However, with a high starting volume level, an increase in volume can increase the listener's stress level, thus conditioning someone to work in a stressful manner, and then changing the music can mean that they become calmer. This effect is similar to that used by athletes who train using powerful pumping music to fire themselves up. This technique could be used to affect a telephone caller's environment by decreasing the volume of music when they enter a more stressful situation such that, on balance, they maintain a reasonable level of behavior. In terms of overall feeling, happiness and anger are both associated with louder music, and sadness and fear are associated with music played at a lower volume. This effect can be used in conjunction with other musical factors to produce an overall emotional affect on a caller.

Music tags associated with compound music commands are summarized in the following table.

| Music tag | Music command |
|---|---|
| Normal | Tempo = normal; Harmonics = normal; Pitch variation = normal; Envelope = round; Amplitude variation = normal |
| Urgent | Tempo = fast; Harmonics = many; Pitch level = high; Pitch variation = large; Envelope = sharpe; amplitiude variation = small |
| Happy | Tempo = fast; Harmonics = few; Pitch level = high; Pitch variation = large; Envelope = sharpe; amplitiude variation = normal |
| Calm | Tempo = slow; Harmonics = few; Pitch level = high; Pitch variation = large; Envelope = sharpe; amplitiude variation = normal |

-continued

| Music tag | Music command |
|---|---|
| Sad | Tempo = slow; Harmonics = few; Pitch level = low; Pitch contour down; Envelope = round |
| Surprise | Tempo = fast; Harmonics = many; Pitch level = high; Pitch variation = large; Pitch contour = up; Envelope = sharp |

Figure 2:
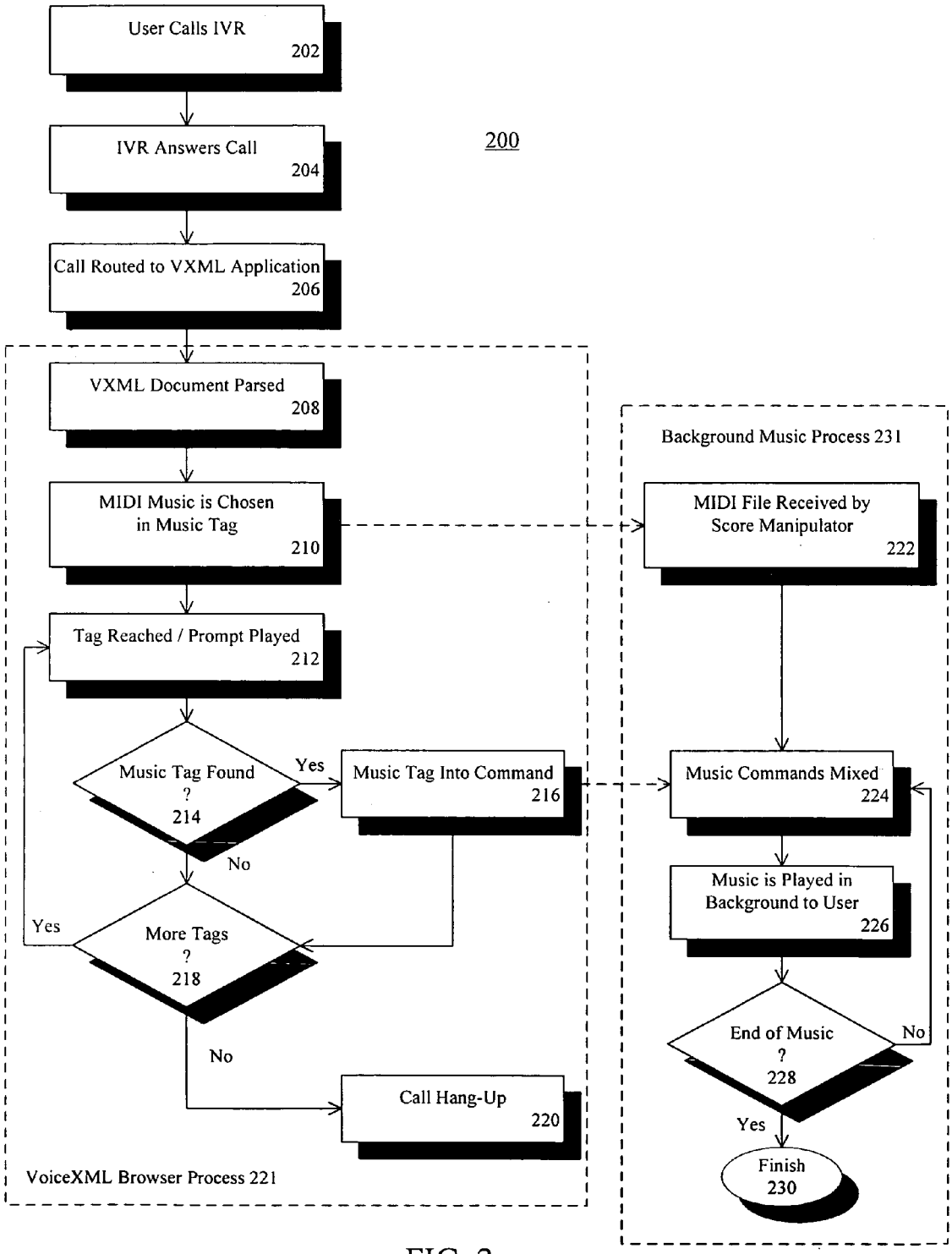
FIG. 2 shows a schematic diagram of the method of the first embodiment.

Referring to steps 202 to 230 in FIG. 2, the process 200 of the telephony voice response system 100 of the first embodiment is described below. The process 200 includes a VoiceXML browser process 221 and a background music process 231.

At step 202, the user calls the IVR 106 to find out some information regarding their account with the IVR service (for example, share prices).

At step 204, the call is picked up by the IVR 106 and assigned a voice channel 112.

At step 206, the call is further assigned a VoiceXML application 114 executed by the VoiceXML browser 116.

Step 208 is the first step in the VoiceXML browser process 221 comprising steps 208 to 220. The VoiceXML browser 116 parses the VoiceXML application. Any VoiceXML tags that are not identified are parsed by the music tag parser 118 and any music tags are sent to the score manipulator 120.

At step 210, a music tag identifying the music score 108 to be played is embedded in the VoiceXML application 114 and passed to the background music process 231 at step 222.

At step 212, a regular VoiceXML tag is located in the application 114 and executed by the VoiceXML browser 116. For example, a regular VoiceXML tag is for playing a message stating that the callers share price has changed.

At step 214, unrecognized VoiceXML tags are passed from the VoiceXML browser 116 to the music tag parser 118. If a music tag is found it is passed to score manipulator 120 at step 216. If no music tag is found then the VoiceXML tag is ignored and the process continues at step 218.

At step 216, the music manipulator 120 converts the music tag into a music command. In this example, the share price has gone down, and a music tag changes the background music to a more consoling style. A weight may be associated with the music tag based upon the severity of the share drop. The music command is passed to the background music process 231 at step 224 while the VoiceXML browser process 221 continues at 218.

At step 218, the VoiceXML browser process 221 checks for more VoiceXML tags in the VoiceXML application 114. If yes then the VoiceXML browser process 221 repeats at step 212 and if no then process continues to 220.

At step 220, the interaction is ended and the call is ended.

Step 222 defines the start of the background music process comprising steps 222 to 230. The identified music score 108 is received by the score manipulator and the music commands are collected into packets for sending to the music synthesizer 110.

At step 224, as part of the background music process 231 the music commands formed from music tags in the VoiceXML application 114 are mixed with music commands from the music score 108 by sending them to the synthesizer 110 between packets of music score music commands.

At step 226, the mixed music score is sent to the music synthesizer 110 to be played out. The background music is then altered at the same time as the share information is played as a voice prompt.

At step 228, the background music process checks for the end of the music indicated by the end of music commands or a specific music command to end the process. If the background music is not to be ended, then the background process 231 repeats at step 224. Otherwise the background music process 231 finishes at 230.

Step 230 is the end of the background music process 231.

Figure 3:
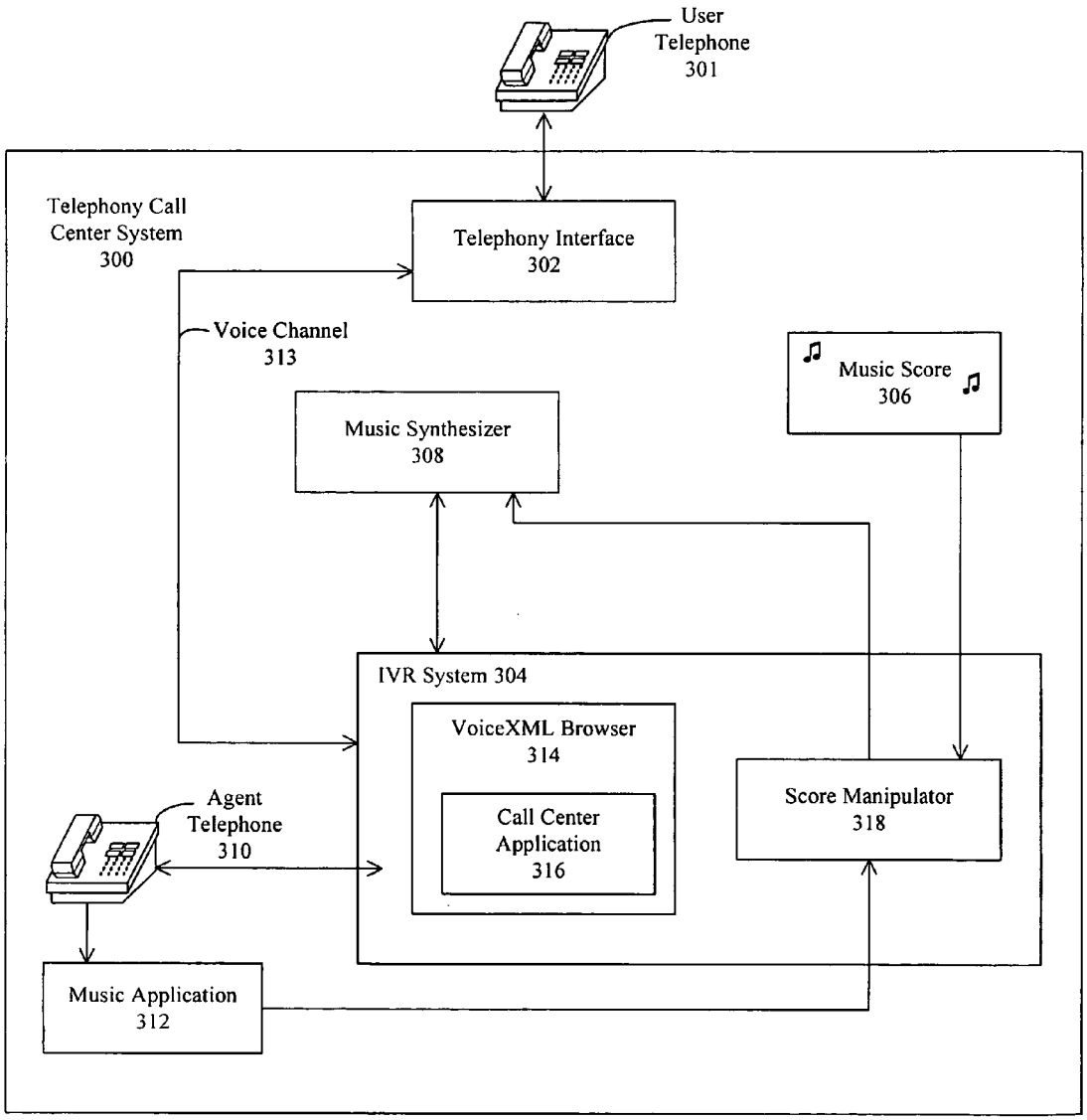
FIG. 3 shows a schematic diagram of a telephony system according to a second embodiment.

Referring to FIG. 3, there is shown a telephony call center system 300 connected to a telephone 301 according to a second embodiment. The telephony call center system 300 can comprise a telephony interface 302, an interactive voice response system (IVR) 304, a music score 306, a music synthesizer 308, an agent telephone 310, and a music application 312. The user telephone connects to the telephony interface and IVR over a telephony network (not shown) through a voice channel and allows a user to speak with an agent on the agent telephone.

In this second embodiment the IVR controls the interaction between the user and the agent or agents. The IVR comprises a VoiceXML browser 314, a VoiceXML application 316, and a music score manipulator 318. The VoiceXML browser 314 parses and interprets the VoiceXML application 316. The VoiceXML application 316 is responsible for handling the call including forwarding it to the agent. The score manipulator 318 forms packets of music commands from the music score 306 and sends them in regular bursts to the synthesizer 308 in a similar way to the first embodiment.

The agent telephone 310 can be one telephone in a call center of telephones. A user can call into the call center and the IVR directs the call to a free agent telephone. Additionally, an agent may directly call a user. In both cases a voice channel 313 is opened between the agent telephone and the user telephone for communication. Background music may also be played out over the voice channel 313. The music score 306 for the background music is fed into the music synthesizer 308 when the agent and the user are connected or when the agent directs using the music application 312.

The music application 312 is an agent interface for the agent. The agent can instruct the music application 312 to send music tags to the score manipulator 318 where they are converted into their associated music commands and sent to the music synthesizer 308.

Figure 4:
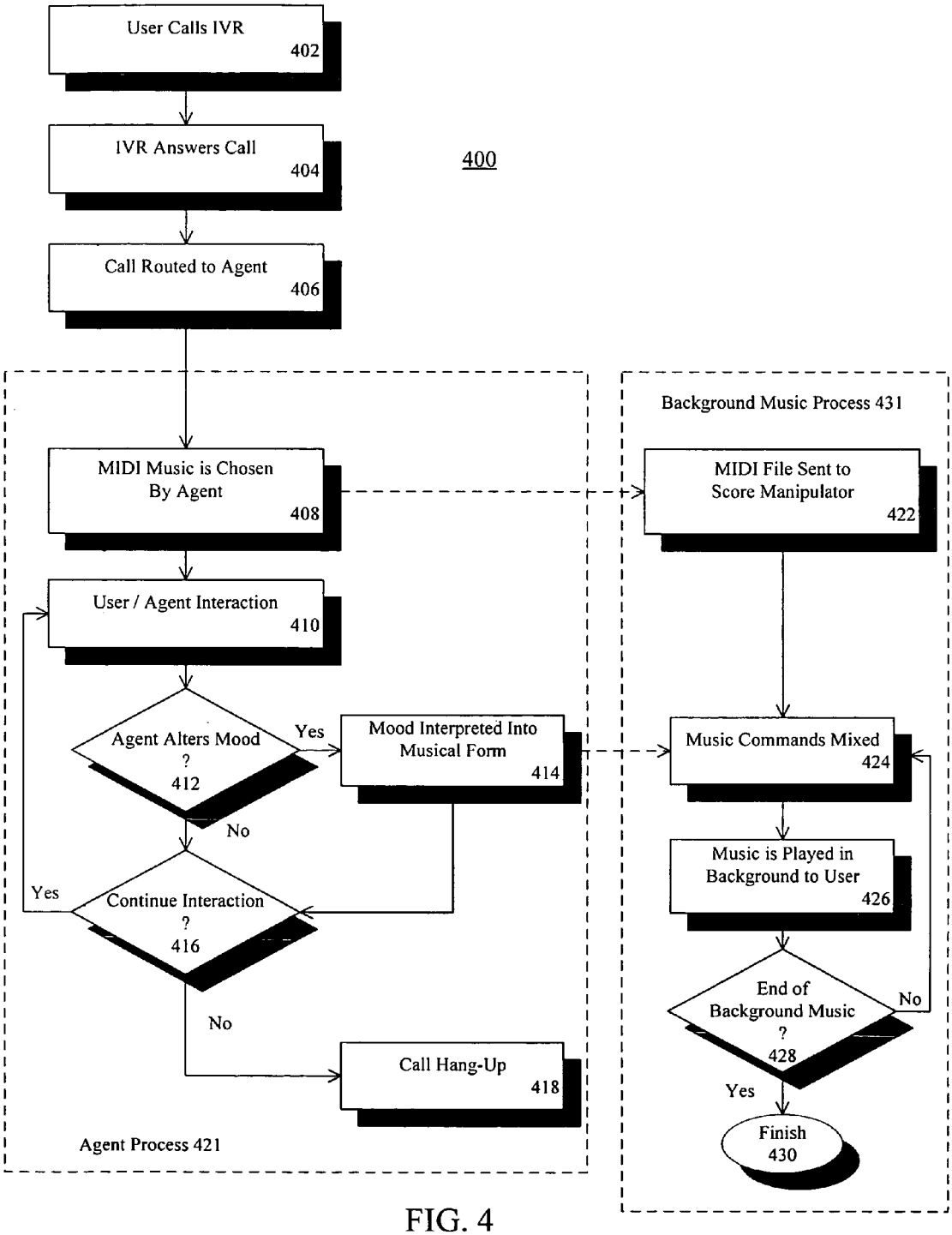
FIG. 4 shows a schematic diagram of the method of the second embodiment.

Referring to steps 402 to 430 in FIG. 4, the process 400 of the second embodiment is described. Process 400 includes agent process 421 and background music process 431.

At step 402, the user telephones the IVR 304 to request information, for example, about some shares.

At step 404, the IVR 304 picks up the call

At step 406, the call is routed to an agent.

Step 408 marks the start of agent process 421 comprising steps 408 to 418. A music score 306 is chosen by the agent and an indication of the chosen music score 306 is sent to the score manipulator 318 (see step 420 of the background music process).

At step 410, the user and agent interact. The user requests information.

At step 412, in response to the request and information to be given, the agent directs the music application 312 to adjust the style of the music. For instance, if the share price has gone down, the agent can change the style of the background music to a more consoling style with a weight based upon the severity of the share drop. The music application 312 sends the appropriate music tag to the score manipulator 318.

At step 414, the score manipulator 318 receives the music tag and converts it into the associated music command. The music command is processed in step 424 of the background music process and the agent process continues at step 416.

At step 416, the agent gives the requested information to the user. If the interaction between the user and the call is to continue then the process goes back to step 410 or otherwise the interaction finishes at step 418.

At step 418, the agent process 421 is over and the call is ended.

Step 422 defines the start of the background music process 431 comprising steps 422 to 430. The identified music score 306 is received by the score manipulator 318 and the music commands are collected into packets for sending to the music synthesizer 308.

At step 424, as part of the background music process 431 the music commands formed from music tags are mixed with music commands from the music score by sending them to the music synthesizer 308 between packets of music commands from the music score 306.

At step 426, the mixed music score is received by the music synthesizer 308 to be played out. The background music is then altered at the same time as the share information is played as a prompt.

At step 428, the background music process 431 checks for the end of the music indicated by the end of music commands or a specific music command to end the process. If the background music is not to be ended then the background process repeats at step 424. Otherwise the background music process finishes at 430.

Step 430 is the end of the background music process.

Referring to FIG. 5 there is shown a VoiceXML application according to the first embodiment of the invention.

A VoiceXML tag, <vxml>, defines the start of the VoiceXML application and </vxml> defines the end (line 501 and 509).

A music tag, <music src="shareshop-bkgnd.mid">, defines the background music score to be played during the interaction. A music tag, </music>, defines the end of the background music (line 502 and 508).

An XML tag, <block>, defines a group of tags to be considered a single subroutine and </block> is an XML tag defining the end of the group (line 503 and 507).

The VoiceXML tags <prompt> and </prompt> define the play prompt operation including between them parameters for playing the prompt. Such parameters include the text for text-to-speech or a file name and location for a pre-recorded prompt and the music tags (lines 504, 505 and 506).

Music tags <music tag="happy"> and </music tag> are associated with music commands for the music synthesizer 110. They may be parameters of the Voice application 114 as a whole or of individual VoiceXML tags such as <prompt>. The first tag defines the start of change to the background music and the second tag defines the end. The parameter in quotes defines which music command is associated with the music tag (line 504, 505, and 506).

Referring to the consecutive lines in FIG. 5.

Step 501 defines the start of the VoiceXML application 114.

Step 502 defines the background music score 108 to be played out.

Step 503 defines the start of a code block.

Step 504 defines a first prompt to be played out including a music tag for "happy" acoustic effects. While the message "Thank you for calling the share shop" is played out to background music with happy acoustic properties as defined by the table above.

Step 505 defines a second prompt to be played out including a music tag for "calm" acoustic effects. The message "Your Acme shares are" is played out to the normal background music but the message "down" is played out to background music with calm acoustic properties as defined in the table for compound music tags.

Step 506 defines a third prompt to be played out including a music tag for "urgent" acoustic effects. The message "The market is closing in 1 minute" is played out to the normal background music and the subsequent message is played out to background music with urgent acoustic properties as defined in the table for compound music tags.

Step 507 defines the end of the program block.

Step 508 defines the end of the background music block.

Step 509 defines the end of the VoiceXML application.

In the first and second embodiment the music synthesizers received the music command in patches similar to real time streaming. In an alternative embodiment, the synthesizer receives the complete music score at once and applies music commands as and when they are received. Another alternative embodiment of the score manipulator allows the music score to be pre-processed prior to sending it to the synthesizer in response to certain music tags. Such pre-processing would change or add acoustic effects to the music score.

While it is understood that the process software 200 and 400 may be deployed by manually loading directly in the IVR via loading a storage medium such as a CD, DVD, etc., the process software may also be automatically or semi-automatically deployed into an IVR by sending the process software to a central server or a group of central servers. The process software is then downloaded into the IVR.

What is claimed is:

1. An interactive voice response system comprising:

a voice application interpreter for processing an interaction with a user;

a music score describing background music for playing during the interaction;

a music synthesizer for generating music from the music score in accordance with acoustic parameters; and means for controlling the music synthesizer whereby the acoustic parameters may be controlled in response to the interaction with the user and independently of the music score, the means for controlling comprising an agent application and score manipulator whereby the interaction is between the user and an agent and the agent controls the acoustic parameters of the synthesizer using the agent application whereby music commands associated with instructions are mixed into a sequence of music commands representing the music score before play out.

2. A computer program product for processing one or more sets of data processing tasks, said computer program product comprising computer program instructions stored on a computer-readable storage medium for, when loaded into a computer and executed, causing a computer to carry out the steps of:

processing an interaction with a user by interpreting a voice application;

playing background music from a music score to the user during the interaction; and controlling the acoustic parameters of the playing step in response to the interaction with the user and instructions in the voice application independently of the music score, whereby music commands associated with instructions are mixed into a sequence of music commands representing the music score before play out.

* * * * *